US010415401B2

(12) United States Patent
Wadsworth et al.

(10) Patent No.: US 10,415,401 B2
(45) Date of Patent: Sep. 17, 2019

(54) AIRFOIL RETENTION ASSEMBLY FOR A GAS TURBINE ENGINE

(71) Applicant: United Technologies Corporation, Farmington, CT (US)

(72) Inventors: Noah Wadsworth, Sturbridge, CT (US); Elizabeth F. Vinson, Broad Brook, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 375 days.

(21) Appl. No.: 15/259,641

(22) Filed: Sep. 8, 2016

(65) Prior Publication Data

US 2018/0066529 A1 Mar. 8, 2018

(51) Int. Cl.
*F01D 5/30* (2006.01)
*F01D 5/06* (2006.01)
(Continued)

(52) U.S. Cl.
CPC ..... *F01D 5/3023* (2013.01); *F01D 5/06* (2013.01); *F01D 5/12* (2013.01); *F01D 5/3015* (2013.01); *F01D 5/326* (2013.01); *F04D 19/02* (2013.01); *F04D 25/045* (2013.01); *F05D 2220/32* (2013.01); *F05D 2230/60* (2013.01); *F05D 2260/30* (2013.01); *F05D 2260/36* (2013.01)

(58) Field of Classification Search
CPC . F01D 5/3023; F01D 5/06; F01D 5/12; F01D 5/3015; F01D 5/326; F01D 5/30; F01D 5/303; F01D 5/3069; F04D 19/02; F04D 25/045; F05D 2220/32; F05D 2230/60; F05D 2260/30; F05D 2260/36
USPC ..... 416/219 R, 220 R, 221
See application file for complete search history.

(56) References Cited

U.S. PATENT DOCUMENTS 4,304,523 A * 12/1981 Corsmeier ..... F01D 5/3015 29/889.21
5,211,407 A * 5/1993 Glynn ..... F01D 11/006 277/632

(Continued)

FOREIGN PATENT DOCUMENTS

EP 2439378 A2 4/2012
GB 2410984 A 8/2005

OTHER PUBLICATIONS

Extended European Search Report for European Patent Application No. EP17189637 completed Jan. 19, 2018.

*Primary Examiner* — Nathaniel E Wiehe
*Assistant Examiner* — Emily S Adelman
(74) *Attorney, Agent, or Firm* — Carlson, Gaskey & Olds, P.C.

(57) ABSTRACT

An airfoil retention assembly for a gas turbine engine includes, among other things, a disk, a coverplate, and a retaining ring. The disk defines a disk axis and an array of slots for receiving airfoil blades. The coverplate is dimensioned to radially overlap the array of slots relative to the disk axis. The retaining ring includes a ring body extending circumferentially about the disk axis between first and second ring ends to define a ring length. First and second retaining features continue along first and second circumferential faces of the ring body, respectively, to define first and second lengths, respectively. At least one of the first and second lengths is less than the ring length.

21 Claims, 8 Drawing Sheets

(51) Int. Cl.

| | |
|---|---|
| ***F01D 5/12*** | (2006.01) |
| ***F04D 19/02*** | (2006.01) |
| ***F04D 25/04*** | (2006.01) |
| ***F01D 5/32*** | (2006.01) |

(56) References Cited

U.S. PATENT DOCUMENTS

| | | | | |
|---|---|---|---|---|
| 5,281,098 | A | 1/1994 | Glynn et al. | |
| 5,302,086 | A * | 4/1994 | Kulesa | F01D 5/3007 416/220 R |
| 5,338,154 | A * | 8/1994 | Meade | F01D 11/001 403/371 |
| 5,993,160 | A | 11/1999 | Bouchard et al. | |
| 6,234,756 | B1 | 5/2001 | Ress, Jr. et al. | |
| 6,951,448 | B2 | 10/2005 | Duesler et al. | |
| 8,348,620 | B2 | 1/2013 | Dejaune et al. | |
| 8,727,735 | B2 | 5/2014 | Lee et al. | |
| 8,979,502 | B2 | 3/2015 | Paquet et al. | |
| 2005/0232760 | A1 * | 10/2005 | Wagner | F01D 5/3015 415/191 |
| 2015/0056068 | A1 * | 2/2015 | Wiebe | F01D 11/08 415/173.1 |
| 2016/0003102 | A1 | 1/2016 | Synnott | |

* cited by examiner

AIRFOIL RETENTION ASSEMBLY FOR A GAS TURBINE ENGINE

STATEMENT REGARDING FEDERALLY SPONSORED RESEARCH OR DEVELOPMENT

The subject of this disclosure was made with government support under Contract No.: N00019-14-C-0004 awarded by the United States Air Force. The government therefore may have certain rights in the disclosed subject matter.

BACKGROUND

This application relates generally to retention of airfoils in a gas turbine engine.

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines. The compressor and turbine sections can include one or more airfoil disks configured to carry an array of airfoils to compress or extract energy from the gas flow.

SUMMARY

An airfoil retention assembly for a gas turbine engine according to an example of the present disclosure includes a disk defining a disk axis and an array of slots configured to receive an array of blades, a coverplate dimensioned to radially overlap the array of slots relative to the disk axis, and a retaining ring that has a ring body extending circumferentially about the disk axis between first and second ring ends to define a ring length. A first retaining feature continues along a first circumferential face of the ring body to define a first length, and a second retaining feature continues along a second circumferential face of the ring body to define a second length. At least one of the first length and second length is less than the ring length.

In a further embodiment of any of the foregoing embodiments, a difference between the ring length and the first length is at least 1.5% of the ring length.

In a further embodiment of any of the foregoing embodiments, the retaining ring is configured such that the first ring end abuts first and second retaining ends of the first retaining feature in a compressed state.

In a further embodiment of any of the foregoing embodiments, the first and second ring ends define a circumferential gap in an uncompressed state. The circumferential gap is less than 1% of the ring length.

In a further embodiment of any of the foregoing embodiments, the circumferential gap is between 0.2% and 0.4% of the ring length in the uncompressed state.

In a further embodiment of any of the foregoing embodiments, the first retaining feature and the second retaining feature are configured to limit radial movement of the coverplate relative to the disk axis.

In a further embodiment of any of the foregoing embodiments, the coverplate is dimensioned to abut a radially extending face of the disk.

In a further embodiment of any of the foregoing embodiments, both the first length and the second length are less than the ring length.

In a further embodiment of any of the foregoing embodiments, the disk includes a disk arm that defines a circumferentially extending ridge dimensioned to receive at least a portion of the retaining ring.

A gas turbine engine according to an example of the present disclosure includes a compressor section that has a first compressor and a second compressor, a turbine section configured to drive the compressor section, and a retention assembly that has a disk defining a disk axis and including an array of slots configured to receive an array of blades, a coverplate configured to abut the array of blades adjacent to the array of slots, and a retaining ring that has a ring body extending circumferentially between first and second ring ends to define a ring length. A first retaining feature extends circumferentially between a first retaining end and a second retaining end. At least one of the first and second retaining ends are circumferentially spaced apart from the first and second ring ends.

In a further embodiment of any of the foregoing embodiments, a first differential length is defined between the first ring end and the first retaining end. A second differential length is defined between the second ring end and the second retaining end. The first differential length and the second differential length is at least 1.5% of the ring length.

In a further embodiment of any of the foregoing embodiments, the retaining ring is configured such that the first ring end abuts the first retaining end in a compressed state, but is spaced apart from the first retaining end in an uncompressed state.

In a further embodiment of any of the foregoing embodiments, the retention assembly is a plurality of retention assemblies each defining a corresponding turbine stage.

In a further embodiment of any of the foregoing embodiments, the disk includes a disk arm and a circumferentially extending ridge dimensioned to receive at least a portion of the retaining ring.

In a further embodiment of any of the foregoing embodiments, the retaining ring includes a second retaining feature extending circumferentially between a third retaining end and a fourth retaining end, the second retaining feature dimensioned to abut a radially extending portion of the disk arm.

In a further embodiment of any of the foregoing embodiments, the first retaining feature and the second retaining feature are configured to limit radial movement of the coverplate relative to the disk axis.

A method of retaining an airfoil in a gas turbine engine according to an example of the present disclosure includes providing a disk defining a disk axis, and having a radially extending disk face. A disk arm defines a circumferentially extending ridge, and an array of slots configured to receive an array of blades, moving at least one blade of the array of blades into one slot of the array of slots, moving a coverplate along the disk axis to abut the disk face, and situating a retaining ring at least partially in the circumferentially extending ridge the retaining ring including a ring body extending circumferentially about the disk axis between first and second ring ends to define a ring length. A first retaining feature continues along a first circumferential face of the retaining ring to define a first length. The first length is less than the ring length.

A further embodiment of any of the foregoing embodiments includes compressing the retaining ring around the disk arm such that the first ring end abuts an end of the first retaining feature, and decompressing the retaining ring such that the retaining ring limits axial movement of the coverplate along the disk axis.

In a further embodiment of any of the foregoing embodiments, the step of decompressing includes defining a circumferential gap between the first and second ring ends, the circumferential gap being less than 1% of the ring length.

In a further embodiment of any of the foregoing embodiments, the retaining ring includes a second retaining feature continuing along a second circumferential face of the retaining ring. The first retaining feature is dimensioned to abut an inner edge of the coverplate and the second retaining feature is dimensioned to abut a radially extending portion of the disk arm.

DETAILED DESCRIPTION

Figure 1:
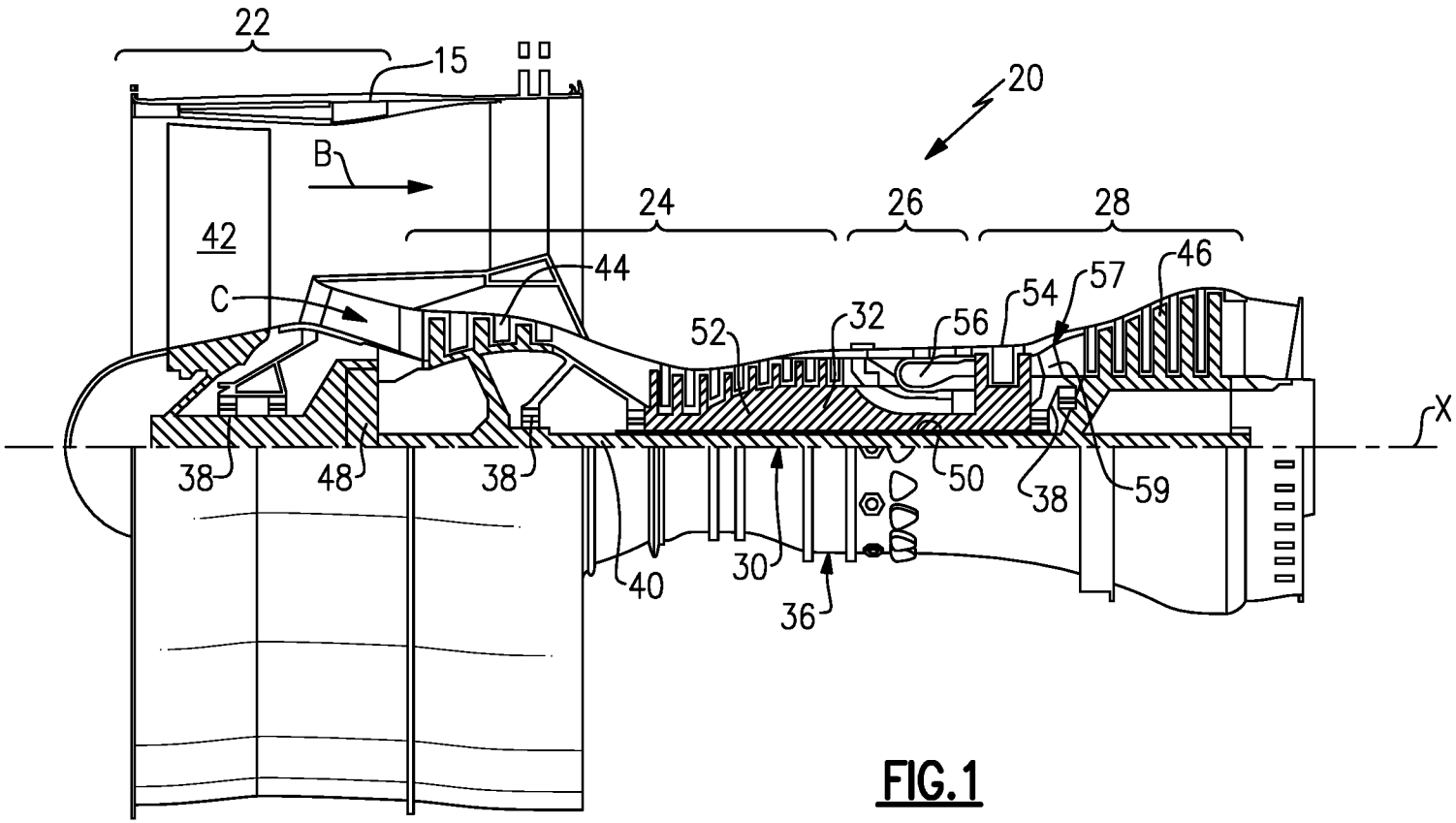
FIG. 1 schematically shows an embodiment of a gas turbine engine.

FIG. 1 schematically illustrates a gas turbine engine 20 for use in a commercial aircraft, for example. The gas turbine engine 20 is disclosed herein as a two-spool turbofan that generally incorporates a fan section 22, a compressor section 24, a combustor section 26 and a turbine section 28. Alternative engines might include an augmenter section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis X relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis X which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of

[(Tram ° R)/(518.7° R)]$^{0.5}$. The "Low corrected fan tip speed" as disclosed herein according to one non-limiting embodiment is less than about 1150 ft/second (350.5 meters/second).

Figure 2:
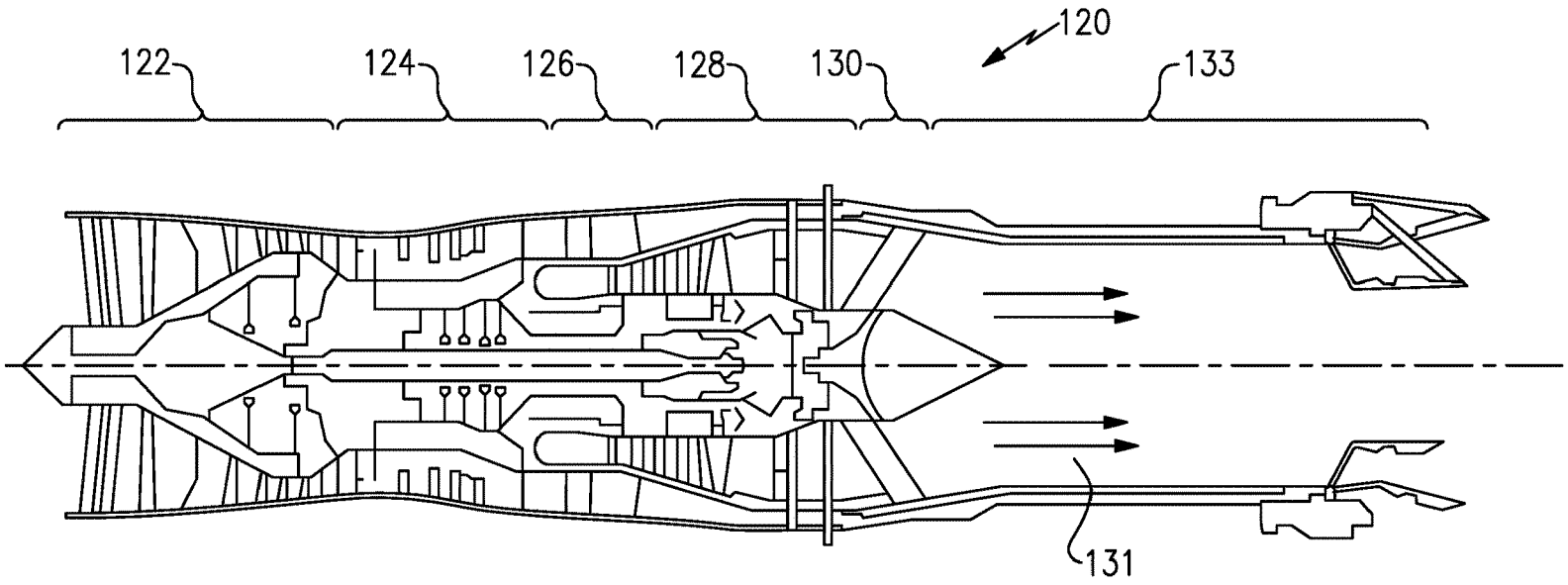
FIG. 2 schematically shows another embodiment of a gas turbine engine.

Referring to FIG. 2, a gas turbine engine 120 according to a second embodiment is disclosed. Engine 120 may be used in a military application, for example, and includes a fan section 122, a compressor section 124, a combustor section 126, and a turbine section 128. Air entering into the fan section 122 is initially compressed and fed to the compressor section 124. In the compressor section 124, the incoming air from the fan section 122 is further compressed and communicated to the combustor section 126. In the combustor section 126, the compressed air is mixed with gas and ignited to generate a hot exhaust stream 131. The hot exhaust stream 131 is expanded through the turbine section 128 to drive the fan section 122 and the compressor section 124. In this example, the gas turbine engine 120 includes an augmenter section 130 where additional fuel can be mixed with the exhaust gasses 131 and ignited to generate additional thrust. The exhaust gasses 131 flow from the turbine section 128 and the augmenter section 130 through an exhaust liner assembly 133.

FIGS. 3A-3D show an airfoil retention assembly 260 in a turbine section 228. In this disclosure, like reference numerals designate like elements where appropriate and reference numerals with the addition of one-hundred or multiples thereof designate modified elements that are understood to incorporate the same features and benefits of the corresponding original elements. Although the retention assembly 260 is primarily discussed relative to turbine section 228, other portions of engine 20/120 may benefit from the teachings herein, including compressor section 24/124.

Turbine section 228 includes rows of airfoils, including stationary vanes 286 and rotating airfoils 214. Each defining a stage of the turbine section 228. The airfoils 214 each have an airfoil body 215 that extends from an airfoil root 223. A blade outer air seal (BOAS) 288 is spaced radially outward from a tip 290 of the airfoil 214. A vane 286 is positioned along the engine axis X and adjacent to the airfoil 214. The turbine section 228 includes multiple airfoils 214, vanes 286, and BOAS 288 arranged circumferentially about the engine axis X.

Each retention assembly 260 includes an airfoil disk 218, a coverplate 229, and a retention ring 234. The turbine section 228 schematically represented in FIG. 3A includes one or more airfoil disks 218 arranged along engine axis X. Each airfoil disk 218 defines one or more slots 227 to carry one or more airfoils 214. The airfoil roots 223 are retained in corresponding slots 227, which may be dimensioned to limit relative radial and circumferential movement. The slots 227 can be uniformly distributed about a circumference of the airfoil disk 218.

Figure 3A:
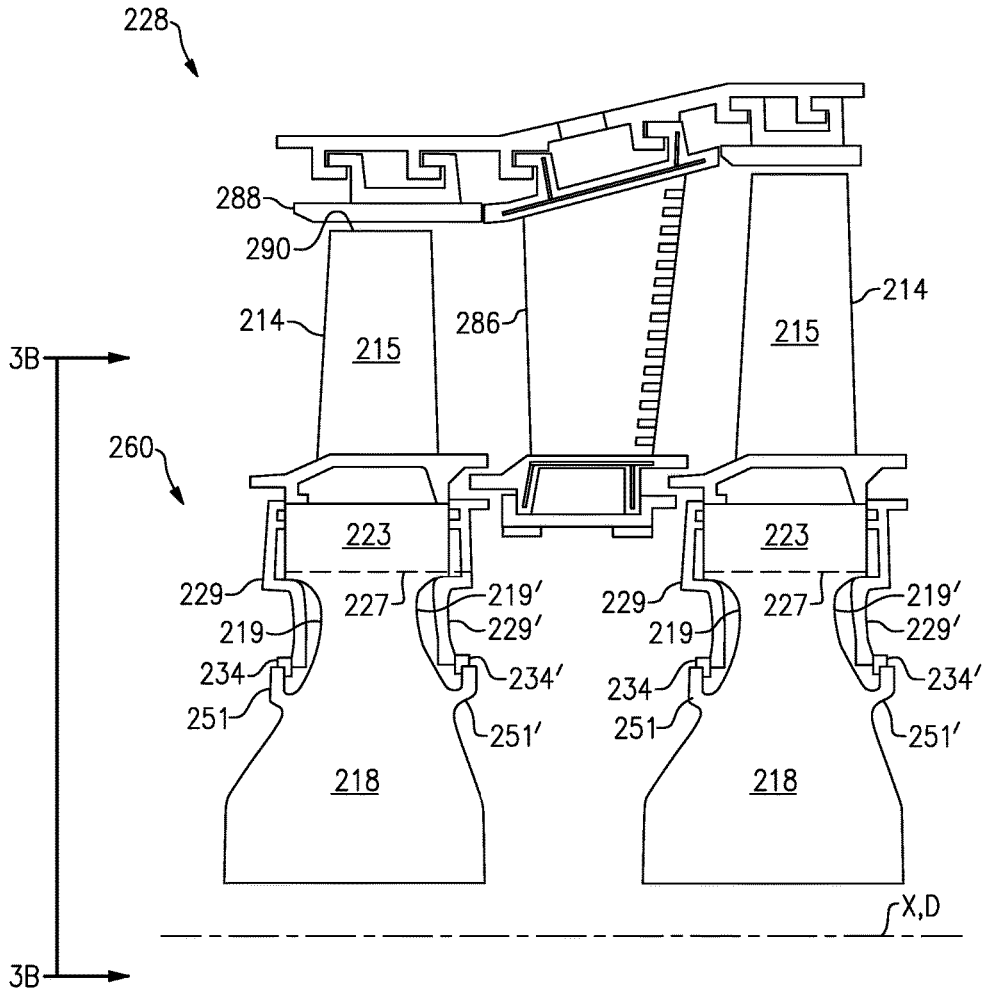
FIG. 3A schematically shows a turbine section of a gas turbine engine.

In the illustrated embodiment of FIG. 3A, the turbine section includes a plurality of retention assemblies 260. In one embodiment, each airfoil disk 218 defines a corresponding turbine stage. In the illustrated example, coverplate 229 and retention ring 234 are situated adjacent to an airfoil face 219. Aft coverplate 229' and retention ring 234' are situated adjacent to aft face 219' of the disk 218 to limit axial movement of the airfoils 214 relative to a disk axis D. The disk axis D can be coaxially aligned with the engine axis X.

The coverplate 229 is dimensioned to radially overlap slots 227 such that the airfoil roots 223 are retained axially in the slots 227. The coverplate 229 is in turn retained by retaining ring 234. In the illustrated embodiment, the coverplate 229 and retaining ring 234 are generally annular, and both extend circumferentially about the disk axis D. The coverplate 229 abuts a forward face 219 of the airfoil disk 218. The aft coverplate 229' abuts an aft face 219' of the airfoil disk 218.

Figure 3B:
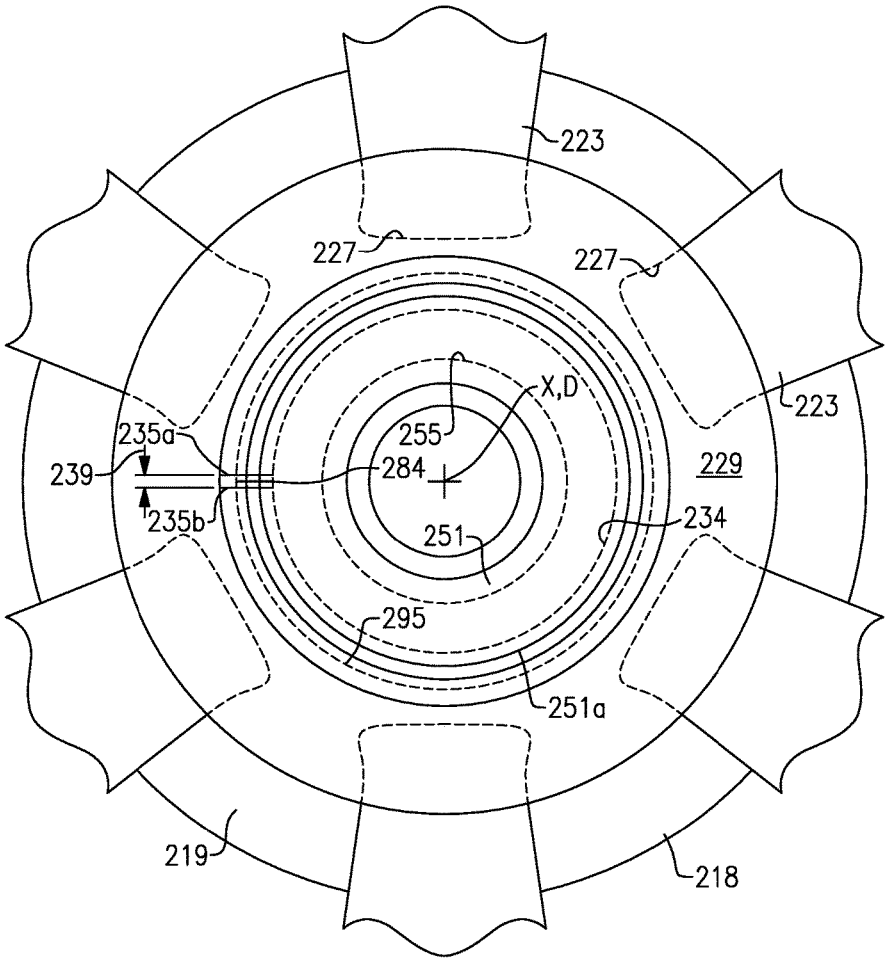
FIG. 3B schematically shows an axial view of an airfoil retention assembly along line 3B-3B of FIG. 3A.
Figure 3C:
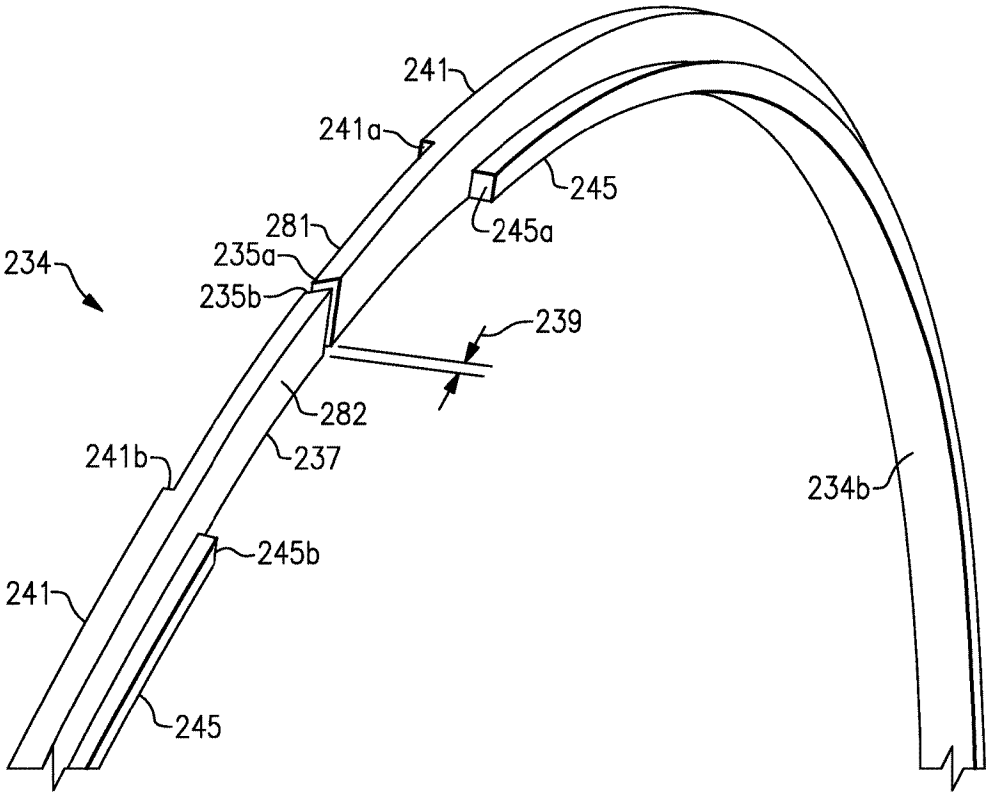
FIG. 3C is an isolated perspective view of portions of a retaining ring.

Referring to FIGS. 3B-3C, with continuing reference to FIG. 3A, the retaining ring 234 includes a ring body 237 that extends circumferentially about the disk axis D between first and second ring ends 235*a*, 235*b*. The retaining ring 234 can be constructed of materials such as high temperature metal alloys. An inner circumference 234*b* of the retaining ring 234 defines a ring length. The ring ends 235*a*, 235*b* are spaced apart in a decompressed state to define a circumferential gap 239 (FIGS. 3B-3C). The gap 239 is small relative to the ring length of the retaining ring. The retaining ring 234 includes outer and inner retaining features 241, 245 that continue along at least a portion of outer and inner circumferential faces 281, 282 of the retaining ring 234 to define a first circumferential length and a second circumferential length, respectively.

Figure 3D:
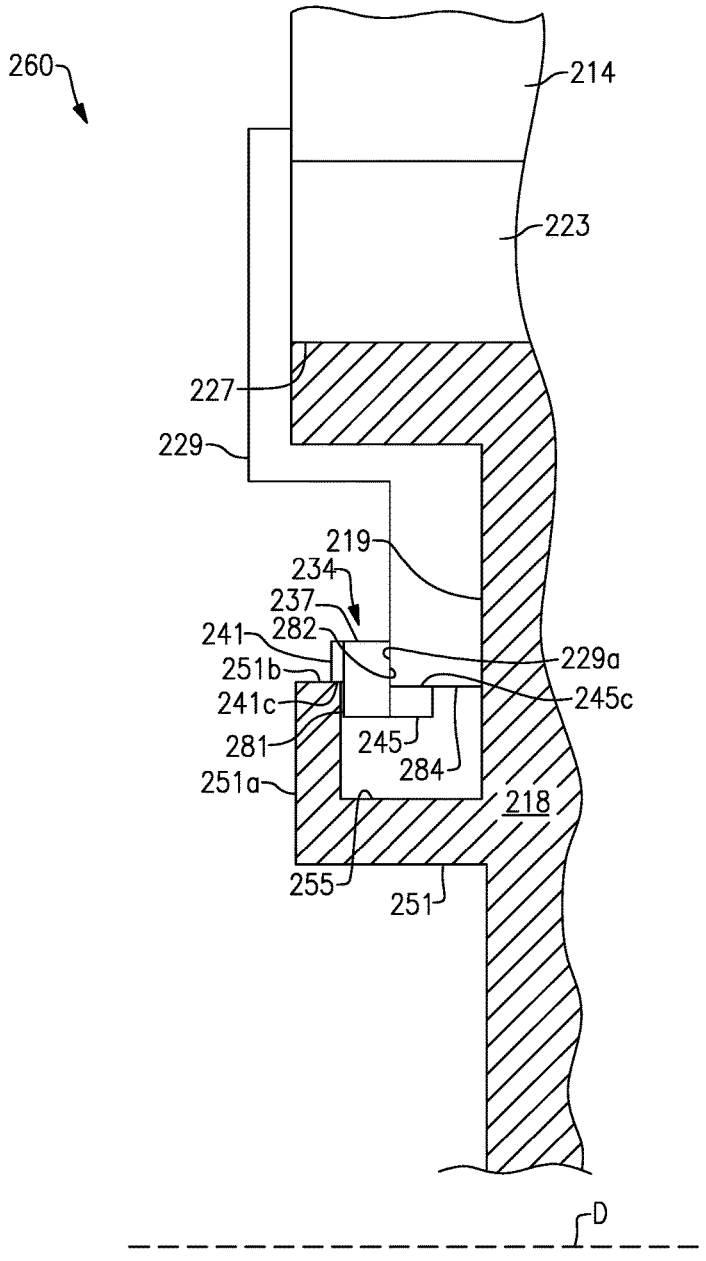
FIG. 3D shows a cross section view of the airfoil retention assembly of FIG. 3A.

Referring to FIG. 3D, with continuing reference to FIGS. 3A-3C, the airfoil disk 218 includes an arm 251 that extends axially from face 219 of the airfoil disk 218 and a radially extending portion 251*a* to define a circumferentially extending ridge 255. The ridge 255 is dimensioned to receive at least a portion of the retaining ring 234. The arm 251 may be integrated with the airfoil disk 218 or may be a separate component attached to the airfoil disk 218. The retaining ring 234 is dimensioned to be disposed at least partially in the circumferentially extending ridge 255 to abut the coverplate 229. The outer retaining feature 241 is dimensioned to sit on the radially extending portion 251*a* of the arm 251. An inner circumference 295 of the coverplate 229 is dimensioned to sit on the inner retaining feature 245. An inner radial face 241*c* of the outer retaining feature 241 abuts an outer face 251*b* radial extending portion 251*a*, and an outer radial face 245*c* of the inner retaining feature 245 abuts an inner edge 284 of the coverplate 229. The retaining ring 234 can be tightly confined between the inner edge 284 of the coverplate 229 and the radial extending portion 251*a* to limit radial movement of the coverplate. A thickness of the ring body 237 of the retention ring 234 is dimensioned to limit axial movement of the coverplate 229 relative to the airfoil disk 218 such that the airfoils 214 are secured in the slots 227 by having a forward face 229*a* of the coverplate 229 in contact with the inner circumferential face 282 of the retaining ring 234 and the outer circumferential face of the retaining ring 281 in contact with the radially extending portion 251*a* of the arm 251.

Figure 4A:
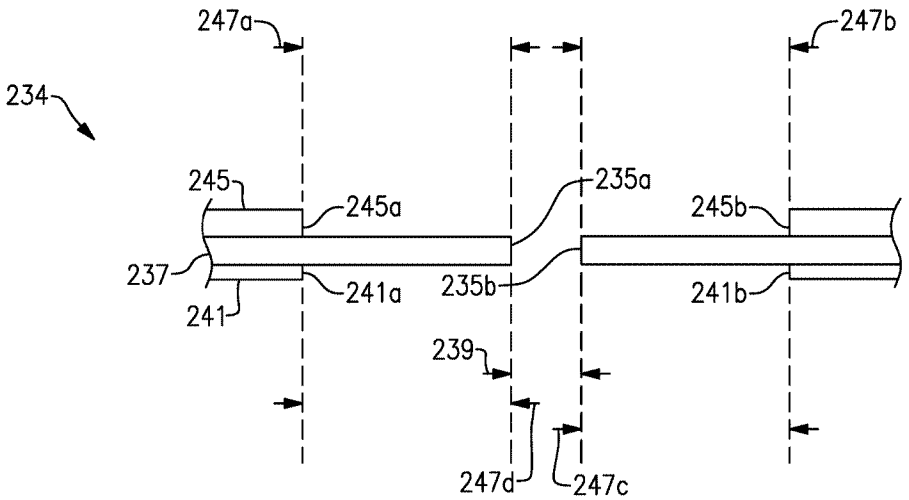
FIG. 4A schematically shows the retaining ring of FIG. 3C in a relaxed state.
Figure 4B:
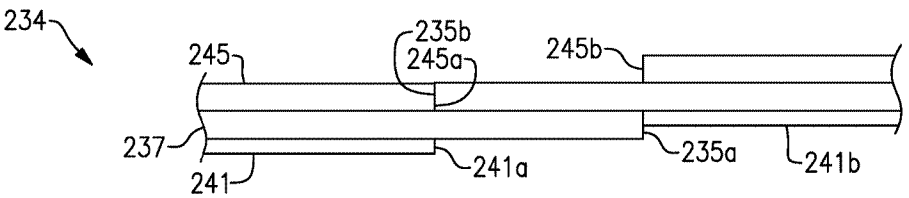
FIG. 4B schematically shows the retaining ring of FIG. 3C in a compressed state.

FIGS. 4A-4B show a plan view of the retaining ring 234 in states of compression and decompression. FIG. 4A shows the retaining ring 234 in a decompressed or relaxed state to define the circumferential gap 239. In an embodiment, a length of the gap 239 in the relaxed state is less than 1% of the ring length. In another embodiment, the length of the gap 239 in the relaxed state is between 0.2% and 0.4% of the ring length. A relatively small gap 239 can reduce stress concentrations in the coverplate 229 otherwise caused by a local lack of axial support by the retaining ring 234.

Differential length 247*a* is defined between retaining end 245*a* and ring end 235*a*, differential length 247*b* is defined between retaining end 245*b* and the ring end 235*b*, differential length 247*c* is defined between retaining end 241*b* and ring end 235*b*, and differential length 247*d* is defined between retaining end 241*a* and ring end 235*a*. At least one of the retaining ends 241*a*/245*a*, 241*b*/245*b* is circumferentially spaced apart from the corresponding ring ends 234*a*, 235*b*. In an embodiment, the differential lengths 247*a*, 247*b* are at least 1.5% of the ring length of the retaining ring 234. In another embodiment, the differential lengths are between 5% and 10% of the ring length. In the illustrated embodiment, differential lengths 247*a*, 247*b*, 247*c*, and 247*d* are of equal lengths. However, differential lengths 247*a*, 247*b*, 247*c*, and 247*d* of varying lengths also come within the scope of the disclosure.

FIG. 4B shows the retaining ring 234 in a compressed state. In the compressed state, the ring ends 235*a*, 235*b* circumferentially overlap such that the gap 239 is closed. Ring end 235*a* abuts retaining end 241*b*/245*b* and ring end 235*b* abuts the retaining end 241*a*/245*a* to limit circumferential movement of the ring ends 235*a*, 235*b* about disk axis D. The retaining ends 241*a*, 241*b*, 245*a*, 245*b* can be defined relative to the ring body 237 to limit a desired amount of compression of the retaining ring 234, while providing a relatively small gap 229 when decompressed.

Figure 5:
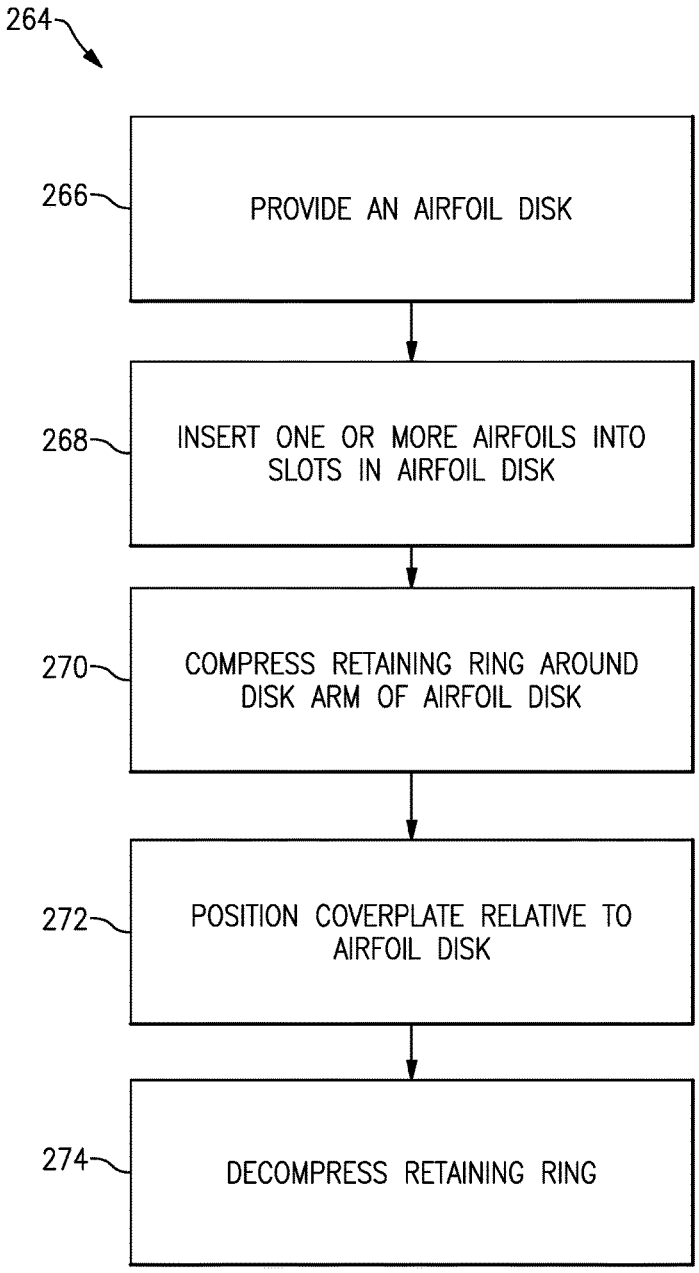
FIG. 5 is flowchart for installing a retention assembly.

FIG. 5 illustrates a method 264 of installation of a retention assembly, such as the retention assembly 260 of FIGS. 3A-3D, according to an embodiment. At step 266, one or more airfoil disks 218 are provided. At step 268, one or more airfoils 214 are inserted into corresponding slots 227 defined by the airfoil disk 218. At step 270, the retaining ring 234 is moved toward the airfoil disk 218 and is situated between the circumferentially extending ridge 255 and the disk face 219. The retaining ring 234 is compressed about the arm 251. At step 272 the coverplate 229 is moved towards the disk 218 adjacent to the slots 227 and into abutment with the radial face 219 of the airfoil disk 218. At step 274, the retaining ring 234 is released and expands or decompresses to urge the coverplate 229 against the face 219. During decompression, the inner radial retaining feature 245 moves outwardly to abut the inner edge 284 of the coverplate 229, and outer radial retaining feature 241 moves into abutment with radially extending portion 251*a*.

Although the different examples have a specific component shown in the illustrations, embodiments of this disclosure are not limited to those particular combinations. It is possible to use some of the components or features from one of the examples in combination with features or components from another one of the examples. Also, although particular step sequences are shown, described, and claimed, it should be understood that steps may be performed in any order, separated or combined unless otherwise indicated and will still benefit from the present disclosure.

Although an example embodiment has been disclosed, a worker of ordinary skill in this art would recognize that certain modifications would come within the scope of this disclosure. For that reason, the following claims should be studied to determine the scope and content of this disclosure.

The invention claimed is:

1. An airfoil retention assembly for a gas turbine engine comprising:

a disk defining a disk axis and an array of slots configured to receive an array of blades;

a coverplate dimensioned to radially overlap the array of slots relative to the disk axis;

a retaining ring including a ring body extending circumferentially about the disk axis between first and second ring ends to define a ring length, a first retaining feature continuing along a first circumferential face of the ring body to define a first length, and a second retaining feature continuing along a second circumferential face of the ring body to define a second length, wherein at least one of the first length and second length being less than the ring length; and wherein the retaining ring retains the coverplate against the disk when the ring is in an decompressed state, and the first and second ring ends are axially aligned relative to the disk axis and define a circumferential gap in the decompressed state.

2. The airfoil retention assembly of claim 1, wherein a difference between the ring length and the first length is at least 1.5% of the ring length.

3. The airfoil retention assembly of claim 1, wherein the retaining ring is configured such that the first ring end abuts one of the first and second retaining ends of the first retaining feature in a compressed state.

4. The airfoil retention assembly of claim 1, wherein the circumferential gap is less than 1% of the ring length.

5. The airfoil retention assembly of claim 4, wherein the circumferential gap is between 0.2% and 0.4% of the ring length in the decompressed state.

6. The airfoil retention assembly of claim 1, wherein the first retaining feature and the second retaining feature are configured to limit radial movement of the coverplate relative to the disk axis.

7. The airfoil retention assembly of claim 6, wherein the coverplate is dimensioned to abut a radially extending face of the disk.

8. The airfoil retention assembly of claim 1, wherein both the first length and the second length are less than the ring length.

9. The airfoil retention assembly of claim 1, wherein the disk includes a disk arm that defines a circumferentially extending ridge dimensioned to receive at least a portion of the retaining ring.

10. The airfoil retention assembly of claim 1, and the first ring end is axially overlapping with the second ring end relative to the disk axis when the retaining ring is in a compressed state.

11. A gas turbine engine, comprising:

a compressor section, including a first compressor and a second compressor;

a turbine section configured to drive the compressor section; and a retention assembly, comprising:

a disk defining a disk axis and including an array of slots configured to receive an array of blades;

a coverplate configured to abut the array of blades adjacent to the array of slots; and a retaining ring including a ring body extending circumferentially between first and second ring ends to define a ring length, a first retaining feature extending circumferentially between a first retaining end and a second retaining end, at least one of the first and second retaining ends being circumferentially spaced apart from the first and second ring ends; and wherein the retaining ring retains the coverplate against the disk when the ring is in an decompressed state, and the first and second ring ends are axially aligned relative to the disk axis and define a circumferential gap in the decompressed state.

12. The gas turbine engine of claim 11, wherein:

a first differential length is defined between the first ring end and the first retaining end;

a second differential length is defined between the second ring end and the second retaining end; and the first differential length and the second differential length is at least 1.5% of the ring length.

13. The gas turbine engine of claim 11, wherein the retaining ring is configured such that the first ring end abuts the first retaining end in a compressed state, but is spaced apart from the first retaining end in the decompressed state.

14. The gas turbine engine of claim 11, wherein the retention assembly is a plurality of retention assemblies each defining a corresponding turbine stage.

15. The gas turbine engine of claim 11, wherein the disk includes a disk arm and a circumferentially extending ridge dimensioned to receive at least a portion of the retaining ring.

16. The gas turbine engine of claim 15, wherein the retaining ring includes a second retaining feature extending circumferentially between a third retaining end and a fourth retaining end, the second retaining feature dimensioned to abut a radially extending portion of the disk arm.

17. The gas turbine engine of claim 16, wherein the first retaining feature and the second retaining feature are configured to limit radial movement of the coverplate relative to the disk axis.

18. A method of retaining an airfoil in a gas turbine engine, comprising:

providing a disk defining a disk axis, and having a radially extending disk face, a disk arm defining a circumferentially extending ridge, and an array of slots configured to receive an array of blades;

moving at least one blade of the array of blades into one slot of the array of slots;

moving a coverplate along the disk axis to abut the disk face;

situating a retaining ring at least partially in the circumferentially extending ridge the retaining ring including a ring body extending circumferentially about the disk axis between first and second terminal ring ends to define a ring length, a first retaining feature continuing along a first circumferential face of the retaining ring to define a first length, wherein the first length is less than the ring length; and decompressing the retaining ring such that the retaining ring limits axial movement of the coverplate along the disk axis and defines a circumferential gap between the first and second terminal ring ends, and such that the first terminal ring end moves from being axially overlapping with the second terminal ring end relative to the disk axis to being axially aligned with the second terminal ring end relative to the disk axis.

19. The method of claim 18, further comprising:

compressing the retaining ring around the disk arm such that the first ring end abuts an end of the first retaining feature.

20. The method of claim 19, wherein the circumferential gap is less than 1% of the ring length.

21. The method of claim 18, wherein the retaining ring includes a second retaining feature continuing along a second circumferential face of the retaining ring, the first retaining feature is dimensioned to abut an inner edge of the coverplate and the second retaining feature is dimensioned to abut a radially extending portion of the disk arm.

* * * * *